US005255445A

United States Patent [19]

Li et al.

[11] Patent Number: 5,255,445

[45] Date of Patent: Oct. 26, 1993

[54] PROCESS FOR DRYING METAL SURFACES USING GASEOUS HYDRIDES TO INHIBIT MOISTURE ADSORPTION AND FOR REMOVING ADSORBED MOISTURE FROM THE METAL SURFACES

[75] Inventors: Yao-En Li, Buffalo Grove; John Rizos, Frankfort; Gerhard Kasper, Downers Grove, all of Ill.

[73] Assignee: American Air Liquide, Chicago Research Center, Countryside, Ill.

[21] Appl. No.: 713,395

[22] Filed: Jun. 6, 1991

[51] Int. Cl.[5] ..... F26B 3/00

[52] U.S. Cl. ..... 34/22; 34/37; 34/9; 34/69

[58] Field of Search ..... 34/22, 37, 34, 69, 15, 34/92, 9, 14, 71

[56] References Cited

U.S. PATENT DOCUMENTS 4,318,749 3/1982 Mayer ..... 34/22
4,916,828 4/1990 Yamane et al. ..... 34/22

FOREIGN PATENT DOCUMENTS 1396565 4/1975 United Kingdom .

OTHER PUBLICATIONS

World Patents Index, Section Ch, Week 7609, Derwent Publications Ltd., London, GB: Class A, AN 76-16446X & SU-A-471 374 (Mindzin) Aug. 28, 1975 *abstract*.

*Primary Examiner*—Henry A. Bennet
*Assistant Examiner*—Denise L. Gromada
*Attorney, Agent, or Firm*—Oblon, Spivak, McClelland, Maier & Neustadt

[57] ABSTRACT

A process for drying a metal surface to enhance the stability of a gas mixture containing one or more gaseous hydrides in low concentration in contact therewith, which comprises: a) purging gas in contact with the metal surface with inert gas to remove the purged gas, b) exposing the metal surface to an amount of a drying agent comprising an effective amount of gaseous hydride of silicon, germanium, tin or lead, and for a time sufficient to dry the metal surface, and c) purging the drying agent using inert gas.

17 Claims, 3 Drawing Sheets

Schematic Diagram of Flow System for $ArH_3$ Study

PROCESS FOR DRYING METAL SURFACES USING GASEOUS HYDRIDES TO INHIBIT MOISTURE ADSORPTION AND FOR REMOVING ADSORBED MOISTURE FROM THE METAL SURFACES

BACKGROUND OF THE INVENTION

1. Field of the Invention

The present invention relates to a process for drying metal surfaces using a drying agent containing gaseous hydrides to inhibit moisture adsorption thereon and for removing adsorbed moisture from the metal surfaces.

2. Description of the Background

Moisture is one of the major impurities in gases, and also appears to play a significant role in causing undesirable changes in gaseous concentrations. This is, in particular, a problem with electronic specialty gases stored in compressed gas cylinders.

Additionally, adsorbed moisture also plays a major role in promoting metal surface corrosion.

At present, the conventional wisdom entails removing moisture by purging or baking out the same. However, it has not been previously known that moisture also has a negative impact on the stability of hydrides. Further, although the deleterious effect of corrosive gases on metal surfaces has been generally recognized, the conventional approach to this problem has been to simply purge or bake out the same.

Thus, a need continues to exist for a metal surface treatment which either eliminates, or at least reduces, the deleterious effects of metal surfaces which have been exposed to moisture or corrosive gases on certain gases and gas mixtures which are susceptible to reacting with moisture on the metal surface.

SUMMARY OF THE INVENTION

Accordingly, it is an object of the present invention to provide a process for eliminating, or at least reducing, the deleterious effects of metal surfaces which have been exposed to moisture on certain gases, gas mixtures and liquids which are susceptible to reacting with moisture on the metal surface.

It is also an object of the present invention to provide a process for reducing moisture outgassing from metal surfaces.

It is, moreover, an object of this invention to provide a process for reducing metal surface corrosion by corrosive gases.

The above objects and others which will become apparent in view of the following disclosure are provided by a process for drying a metal surface to enhance the stability of a gas mixture containing one or more gaseous hydrides in contact therewith, which comprises:

a) purging gas in contact with the metal surface with inert gas to remove the purged gas, b) exposing the metal surface to an amount of a drying agent comprising an effective amount of a gaseous hydride of silicon, germanium, tin or lead, and for a time sufficient to dry the metal surface, and c) purging the drying agent using inert gas.

DETAILED DESCRIPTION OF THE PREFERRED EMBODIMENTS

Figure 1:
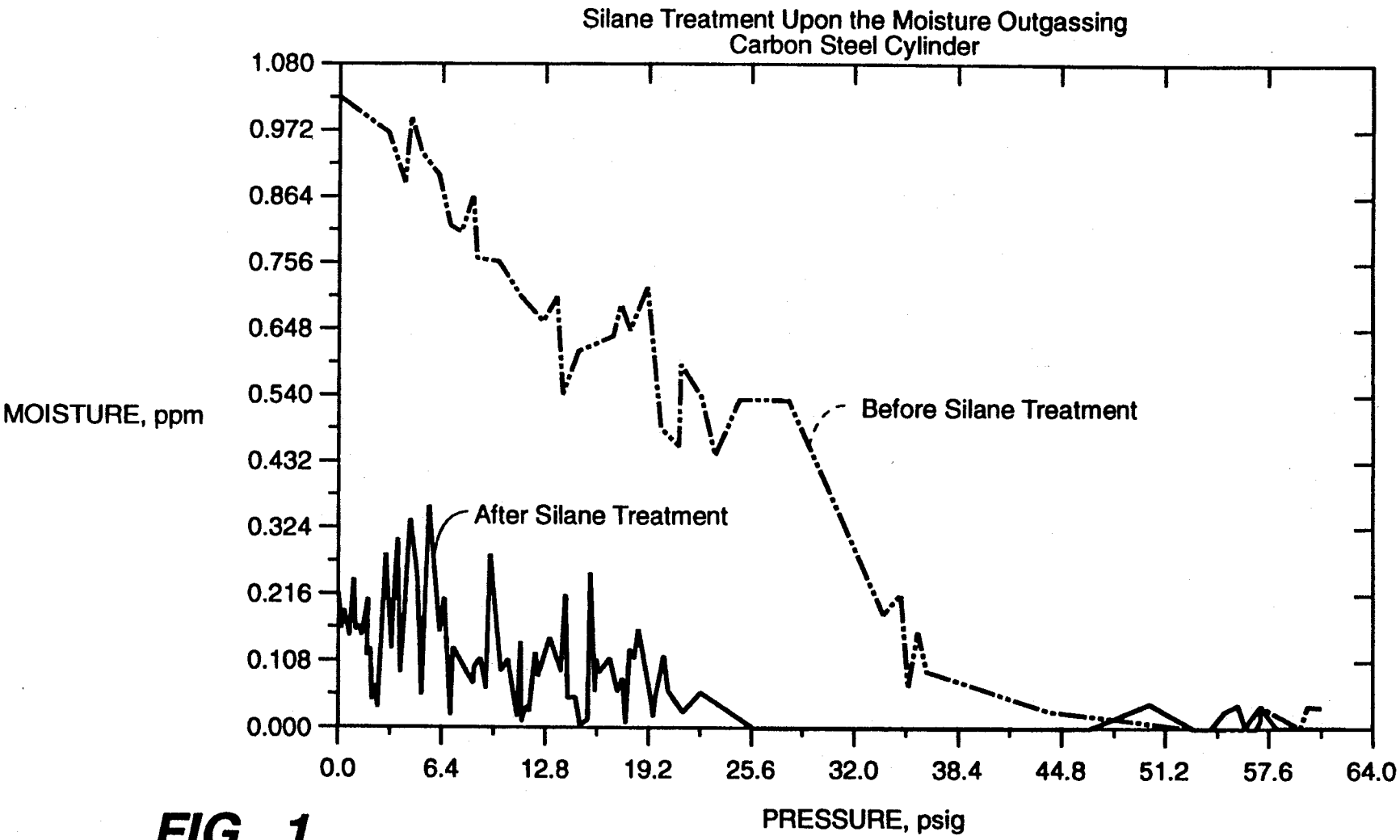
FIG. 1 illustrates the effect of the present invention upon the moisture outgassing of a carbon steel cylinder.

In accordance with the present invention, it is has been discovered that metal surfaces can be dried to inhibit moisture adsorption and that adsorbed moisture can be removed from the metal surface.

Thus, the present invention provides a process for eliminating, or at least significantly reducing, moisture outgassing from metal surfaces.

In accordance with the present invention, a process is also provided for reversing and eliminating the deleterious effects of metal surfaces which have been exposed to moisture or liquid water on certain gases, such as gaseous hydrides and/or corrosive gases, such as hydrogen chloride and fluorine, for example, which are susceptible to reacting with moisture on the metal surface. Such gases, gas mixtures or liquids which are susceptible to reacting with moisture are well known to those skilled in the art. They may be inorganic or organic, such as phosgene, for example.

As used herein, the terms "metal" or "metal surfaces" refer to any metal, particularly those which are useful in making gas storage cylinders, conduits, containers, pipes and any type of storage means including railroad tank storage cars and tank truck trailer rigs. Also, the metal surface may be, for example, metal tubing or metal valves.

Notably, the metal or metal surface may not only be those used in gas or liquid storage means, but also those used in piping, transferring or routing gases, gas mixtures or liquids in pipes or conduits.

For example, metals such as iron, steel and aluminum may be dried in accordance with the present invention.

The present invention may, for example, be used in the treatment of various steels and alloys thereof, such as ferrite steels, austenitic steels, stainless steels and other iron alloys.

Generally, the present invention is used to dry a metal surface using relatively non-toxic gaseous hydrides to enhance the stability of gas mixtures containing gaseous hydrides in low concentration, particularly toxic gaseous hydrides, such as arsine, phosphine or stilbine, and/or to enhance the stability of corrosive gases. This is effected by eliminating, or at least reducing, the deleterious effects of metal surfaces which have been exposed to moisture on such gases, gas mixtures or liquids which are susceptible to reacting with moisture on the metal surface.

As used herein, the term "non-toxic gaseous hydrides" includes the silicon hydrides, germane hydrides, tin hydrides and lead hydride. The toxic gaseous hydrides such as arsine, stilbine or phosphine are avoided.

Of particular usefulness are silicon hydrides of the general formula $Si_nH_{2n+2}$, such as $SiH_4$, $Si_2H_6$ and $Si_6H_{14}$.

In the above formula for silicon hydrides, n is generally from 1 to about 10. However, n can be a higher value as silicon hydrides are known to exhibit cantenation. See *Advanced Inorganic Chemistry,* Cotton and Wilkinson, Third Edition. It is preferred, however, that n is 1.

Further, as used herein, the phrase "gaseous hydrides in low concentration," referring to the gas mixture which can be stabilized, generally means gaseous hydrides of a concentration of about from 10 ppb to about 10 ppm, such as arsine, phosphine or stilbine. More preferably, the concentration is about 50 ppb to about 5 ppm. Most preferably, however, the concentration is about 100 ppb to about 1 ppm.

In accordance with the present invention, in order to dry a metal intended for subsequent exposure to a gas mixture containing gaseous hydrides in low concentration in contact therewith and/or corrosive gases, gas mixtures or liquids, it is first necessary to purge the gas or gas mixture initially in contact with the metal surface with inert gas to remove the purged gas. As an inert purging gas, any gas which is generally chemically non-reactive may be used. For example, the so-called noble gases, such as krypton, xenon, helium, neon and argon may be used. However, other gases such as hydrogen and nitrogen may be used.

Generally, the inert purging gas is passed over the metal surface for a time and in an amount sufficient to remove substantially all of the purged gas, i.e., generally greater than about 99% by volume. Typically, the purging gas is passed over the metal surface, or through a volume defined by a continuous metal surface, such as a compressed gas storage cylinder, for anywhere from several seconds to up to about 30 minutes at from 1 to about 3 atmospheres of pressure. However, higher pressure may be used, if desired.

In accordance with the present invention, nitrogen has been found to be advantageous as an inert purging gas, although other inert gases may be used.

After purging gas in contact with the metal surface, such as air, the metal surface is then exposed to an amount of a drying agent containing an effective amount of one or more gaseous hydrides of silicon, germanium, tin or lead, and for a time sufficient to dry the metal surface.

Generally, the higher the concentration of drying agent used, the shorter the exposure time required. However, drying agent concentrations of as low as 1 ppm may be used, or as high as 100%. For example, if a very low concentration of drying agent is used, exposure times in excess of 80 hours are usually required. In general, exposure times of about 100 hours are typically used for dilute drying agents. However, if relatively pure drying agent is used, for example, generally less than 60 minutes exposure time is required, preferably less than 30 minutes.

As described above, the phrase "pure drying agent" means that the drying agent used is the pure gaseous hydride of one or more of silicon, germanium, tin or lead.

While any concentration of drying agent may be used, it is generally desirable to use a drying agent concentration in the range of about 0.01% to 20% by volume. It is preferred, however, to use a concentration in the range of about 0.01% to 5% by volume. With such concentrations, an exposure time of from about 1 to 30 minutes is generally required. However, the lower the concentration used, the longer the exposure time required. Generally, for larger metal surfaces, such as vessels, larger volumes of drying agent may be used.

In accordance with the present invention, substantially all of the purged gas is displaced or removed by the inert gas, i.e., greater than about 99% by volume.

Generally, the purged gas is air, however, other gases or gas mixtures, such as mixtures mainly containing nitrogen and oxygen, may be purged in accordance with the present invention.

Further, the exposure of the metal surface to the drying agent may be effected in general, from very low temperatures of about −20° C. to up to right below the decomposition temperature of the one or more gaseous hydrides in the drying agent. For example, the decomposition temperature of silane is 250° C. However, it is generally preferable to effect the exposure at from about 10° C. to about 100° C. It is more preferable to effect the drying agent exposure at from about 20° C. to about 50° C. However, it is most advantageous to effect the exposure at about 25° C.

After subjecting the metal surface to treatment with drying agent, the latter is, itself, purged with an inert purging gas, such as nitrogen. However, the noble gases described above may be used.

The present invention also provides an optional fourth step in which the metal surface is then exposed to an oxidizing gas in order to stabilize the adsorbed drying agent on the metal surface. As an oxidizing gas, gas mixtures containing nitrogen and oxygen may be used, for example.

Generally, oxidizing gas mixtures may be used which are capable of oxidizing the adsorbed drying agent to an inert oxidized form. For example, gas mixtures containing from about 1 to 10% by volume of oxygen in nitrogen may be advantageously used. When using such mixtures to oxidize the adsorbed drying agent, metal surface exposure times of from about 30 seconds to about 3 minutes are generally used. However, shorter or longer exposure times may be used as required.

In accordance with this aspect of the present invention, it has been discovered that adsorbed gaseous hydride may be desorbed very slowly over a period of time thus reducing the effectiveness of the drying treatment over time. By oxidizing the adsorbed gaseous hydride, such as silane, for example, an inert compound, such as $SiO_2$, may be formed. Hence, the oxidation step provides a means for stabilizing the dried metal surface for long term use.

Additionally, the effect of the present invention may be enhanced by using two or more cycles of metal surface treatment. That is, the effect achieved by subjecting a metal surface to the present drying agent can be enhanced with a second and subsequent drying agent treatment, particularly if the metal surface has been contacted with moisture after the first drying agent treatment. This may be seen from FIG. 4.

While any number of multiple treatments may be used, it is generally sufficient for enhanced protection against moisture to effect only a second and then a third treatment. However, some enhanced protection can be obtained with only a second treatment and further treatments, such as a fourth, fifth or higher number of treatments may be effected as needed.

FIGS. 1–5 will now be described in more detail.

FIG. 1 provides an illustration of the effect of the present invention, using silane, for example, upon the moisture outgassing of a carbon steel cylinder. Notably, for conventional storage means, moisture levels rise suddenly as the storage means becomes empty.

Figure 2:
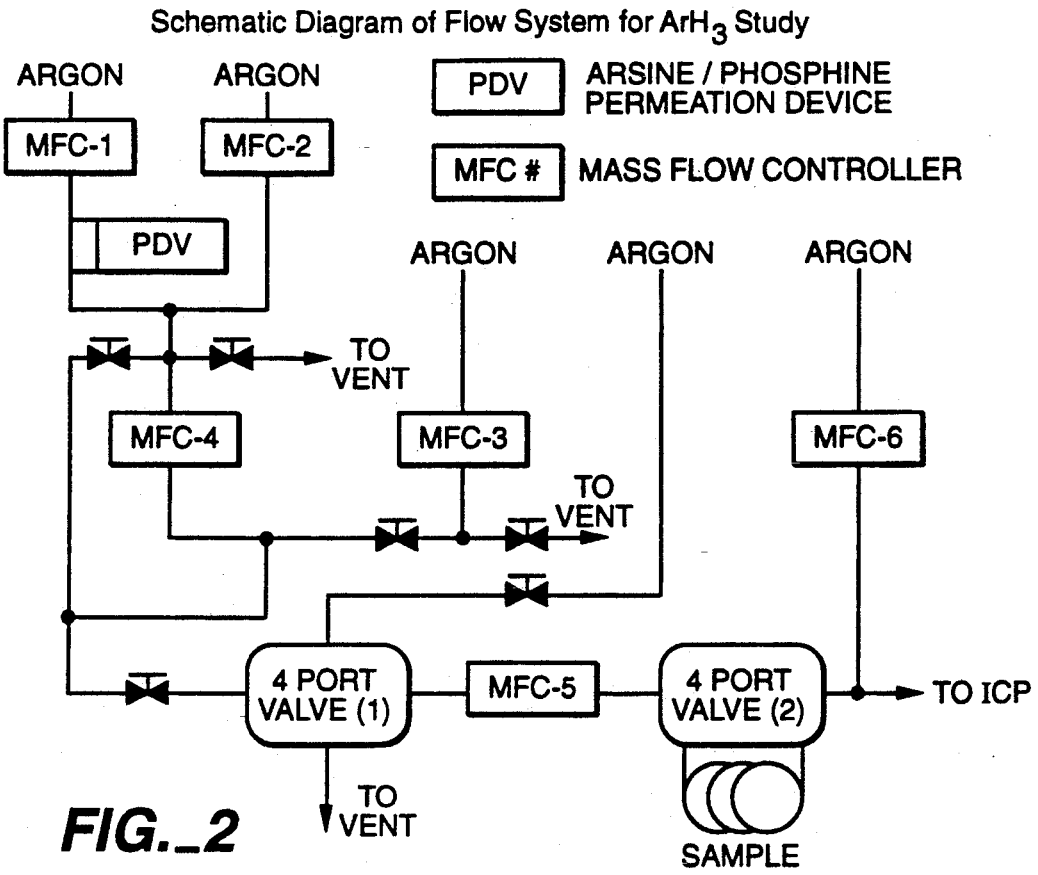
FIG. 2 illustrates a schematic diagram of a flow system for a study of $ArH_3$.

FIG. 2 illustrates a schematic diagram of a flow system for a study of $ArH_3$.

Figure 3:
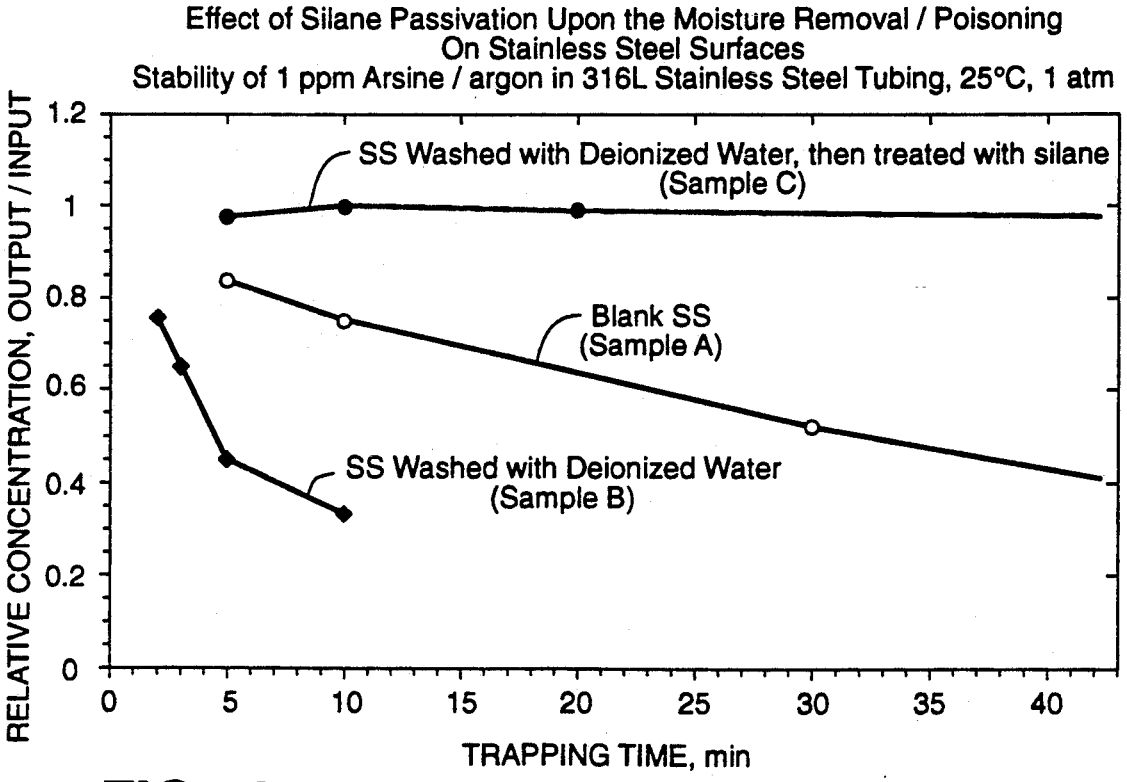
FIG. 3 illustrates the effect of the present invention upon the removal of moisture from a stainless steel surface.

FIG. 3 illustrates the effect of the present invention, in particular using silane, for moisture removal from a stainless steel surface.

To further strengthen the causal relationship of silane and moisture, a repeated switching test between conditions 2 and 3 was performed. Conditions 2 and 3 refer to the conditions noted for FIG. 4. A tube sample which was previously rinsed with deionized water and treated with silane (FIG. 3, curve 3), was rerinsed with deionized water and tested with arsine in the same manner as the samples in FIG. 3. FIG. 5 shows that this sample (square denoted) displays a slight negative effect upon hydride stability, but not nearly as much as a rinsed sample (i.e., FIG. 3, curve 2). This same sample was then retreated with silane and tested with arsine in the same manner as the samples in FIG. 3. This sample (FIG. 5, triangle denoted) clearly shows that retreatment with silane completely eliminates the observed moisture effect on hydride stability.

Figure 4:
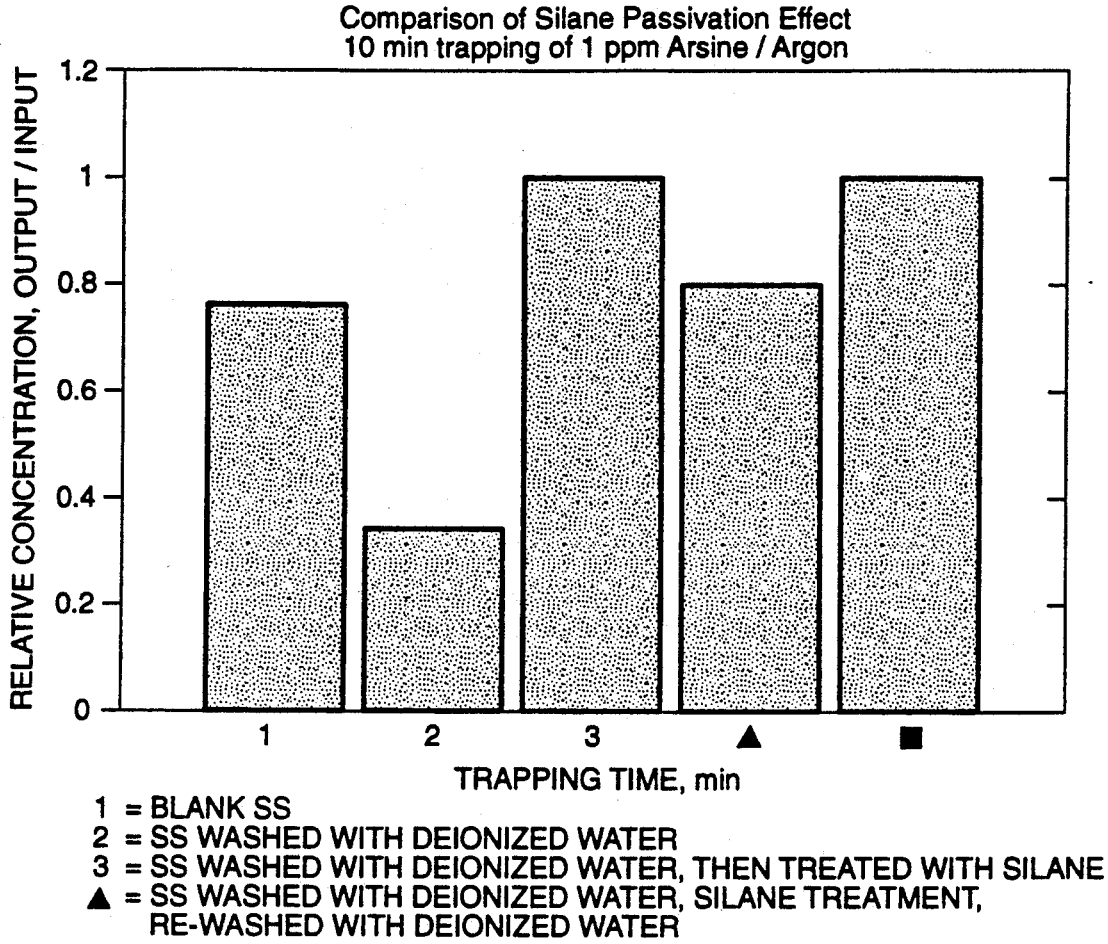
FIG. 4 illustrates a comparison of results obtained using the present invention in multiple drying cycles.
Figure 5:
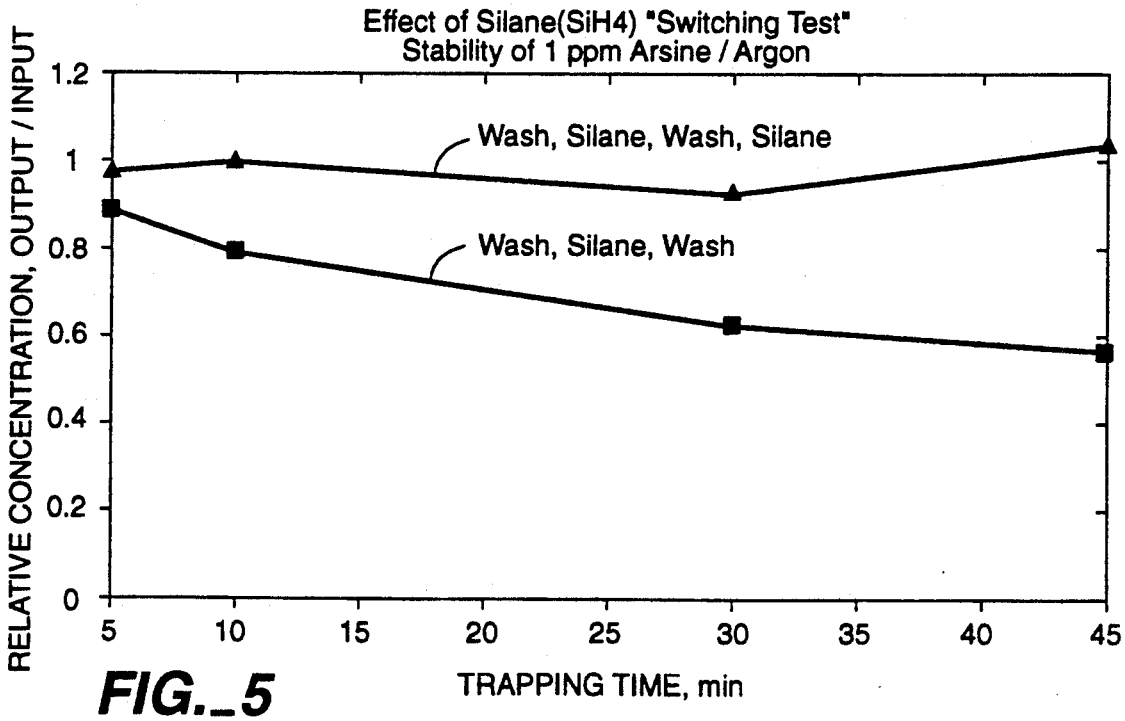
FIG. 5 illustrates the results obtained for the silane ($SiH_4$) "Switching Test."

To more clearly depict the effect of the repeated switching between conditions 2 and 3, FIG. 4 was constructed from data depicted in FIG. 3 and FIG. 5. The points depicted in FIG. 4 represent the 10 min., 1 ppm arsine/argon trapping values of FIGS. 3 and 5. Bars 1, 2 and 3 represent the corresponding 10 min. trap values from FIG. 3, and the "triangle" and "square" bars represent the corresponding 10 min. trap values from FIG. 5. FIG. 4 clearly shows that exposure of the metal surface to water has a strongly negative effect on hydride stability if data from a blank SS sample (Bar 1) is compared with the data from a moisture exposed sample (Bar 2). It can then be seen that treatment with silane eliminates the moisture effect upon hydride stability (cf. Bar 2) and actually increases the stability to a level which exceeds that of the blank SS sample (cf. Bar 1). It can then be seen that re-exposure to moisture (triangle denoted Bar) decreases hydride stability somewhat, but not to the levels displayed by blank or moisture exposed samples (cf. Bar 1, Bar 2, respectively). Finally, it can be seen that retreatment of a sample with silane (square denoted Bar) increases hydride stability, and virtually restores the sample to the condition that was seen after the first silane treatment (i.e., Bar 3). This data indicates that repeated silane treatments enhance hydride stability to an eventual point where effects of subsequent moisture exposures are negligible or non-existent.

The present invention will now be further illustrated by reference to certain examples which are provided solely for illustration and are not to be considered as being limitative.

EXAMPLE 1

Inhibition of moisture outgassing in a steel cylinder

Measurements of trace levels of moisture in cylinder gas as a function of cylinder pressure are a conventional method for determining the quality of dryness of cylinders. This is practiced routinely in industry. Typically, the moisture level follows a curve such as the upper curve in FIG. 1. In other words, moisture levels rise rather suddenly as cylinder becomes empty. This is due to the outgassing mechanism of moisture known to exist on the inner cylinder walls.

In the present experiment, a single carbon steel cylinder was exposed to ambient air under the conditions typical in the preparation of gas cylinders. The sample was evacuated and pressurized for several cycles, then the cylinder was filled with $N_2$ to 60 psig and held at that pressure for about 12 hours. The moisture level in the $N_2$ was then measured by a moisture analyzer. The result is shown in FIG. 1.

The same sample cylinder was then subjected to the silane treatment as follows: the cylinder was filled with 1% $SiH_4$/He to 8 psig and then evacuated after 30 minutes. Then the sample went through several pressure/vacuum cycles in order to remove silane inside the cylinder. Finally, the cylinder was filled with dry $N_2$ to 60 psig and held at that pressure for about 12 hours. The moisture level in the $N_2$ was again measured. The improvement is also shown in FIG. 1.

EXAMPLE 2

Reducing the effects of moisture exposure to metal surfaces for gas stability This effect was demonstrated with hydrides, where the relationship between moisture on surface and stability is least obvious.

Three identical samples (A, B and C) of ¼" stainless steel tubing were purged with dry $N_2$ at room temperature. Samples B and C were rinsed with deionized water under the conditions typical in the preparation of gas handling and storage equipment, followed by purging with dry $N_2$ at 200° C. for 2 hours; sample C was additionally treated with flowing silane for 30 minutes at room temperature, followed by purging with dry air and dry $N_2$ to remove silane, according to the conditions in the previous disclosure.

The stability of hydride gas in so prepared samples A, B and C was tested in a setup as shown in FIG. 2. The tubes were filled with argon gas containing 1 ppm arsine. This gas was kept in the tube by means of the valve 2 in FIG. 2 for various amounts of time. After that, the gas was introduced into a device capable of measuring the concentration of hydrides remaining in the gas. In this case, the device is an Inductively Coupled Plasma spectrophotometer. The ratio of initial fill concentration to final concentration was used as a measure for the gas stability. The results for a typical test with arsine shown in FIG. 3.

As one observes in FIG. 3, curve 2 shows that exposure of the metal surface to water has a very negative effect on hydrides stability. The silane treatment completely eliminates this effect (curve 3).

FIG. 3 also shows that the tube in its initial (as purchased) condition already has a strong effect on hydride stability due to the exposure to ambient moisture (curve 1). Water washing will further worsen the condition (curve 2).

Having described the present invention, it will now be apparent to one skilled in the art that many changes and modifications may be made to the above-described embodiments without departing from the spirit and the scope of the present invention.

What is claimed as new and desired to be secured by Letters Patent of the United States is:

1. A process for drying a metal surface to enhance the stability of a gas mixture containing one or more gaseous hydrides in low concentration in contact therewith, which comprises:

(a) purging gas in contact with said metal surface with inert gas to remove purged gas, (b) exposing the metal surface to an amount of a drying agent comprising an effective amount of one or more gaseous hydrides selected from the group consisting of silicon, germanium, tin and lead, and for a time sufficient to dry the metal surface, and (c) purging the drying agent using inert gas.

2. The process of claim 1, wherein said metal surface comprises steel, iron or aluminum.

3. The process of claim 1, wherein said metal surface is a compressed gas storage cylinder.

4. The process of claim 1, wherein said purged gas is air.

5. The process of claim 1, wherein said inert gas is nitrogen, argon, krypton, helium, xenon or neon.

6. The process of claim 1, wherein said one or more gaseous hydrides in low concentration are selected from the group consisting of phosphine, arsine and stilbine.

7. The process of claim 1, wherein said drying agent comprises one or more gaseous hydrides selected from the group consisting of a silicon hydride of the formula $Si_nH_{2n+2}$, wherein n is from 1 to about 10; $Ge_2H_6$, $Ge_9H_{20}$, $SnH_4$, $SnH_6$ and $PBH_4$.

8. The process of claim 7, wherein said silicon hydride is $SiH_4$.

9. The process of claim 1, which further comprises after step c), exposing the metal surface to an oxidizing gas or gas mixture in an amount and for a time sufficient to stabilize the adsorbed drying agent on the metal surface.

10. The process of claim 1, which further comprises repeating a cycle of steps a), b) and c) one or more times.

11. A process for stably storing gases, gas mixtures or liquids which are susceptible to reacting with moisture on a metal surface, which comprises:

a) purging gas in contact with the metal surface of storage means with inert gas to remove the purged gas, b) exposing the metal surface to an amount of a drying agent comprising an effective amount of one or more gaseous hydrides of silicon, germanium, tin or lead, and for a time sufficient to dry the metal surface, c) purging the drying agent using inert gas, and d) filling said storage means with said gases, gas mixtures or liquids which are susceptible to reacting with moisture on a metal surface.

12. The process of claim 11, wherein said metal surface comprises steel, iron or aluminum.

13. The process of claim 11, wherein said metal surface is a compressed gas storage cylinder.

14. The process of claim 11, wherein said purged gas is air.

15. The process of claim 11, wherein said inert gas is nitrogen, argon, krypton, helium, xenon or neon.

16. The process of claim 11, wherein said drying agent comprises one or more gaseous hydrides selected from the group consisting of a silicon hydride of the formula $Si_nH_{2n+2}$, wherein n is from 1 to about 10; $Ge_2H_6$, $Ge_9H_{20}$, $SnH_4$, $SnH_6$ or $PbH_4$.

17. The process of claim 11, wherein said silicon hydride is $SiH_4$.

* * * * *